United States Patent [19]

Singer et al.

[11] Patent Number: 4,949,407

[45] Date of Patent: Aug. 21, 1990

[54] SHAMPOO BASIN NECK REST

[76] Inventors: Cy A. Singer, 1500 Malcolm Ave., Los Angeles, Calif. 90024; Anthony L. Davis, #4 Privateer St., Marina Del Rey, Calif. 90292

[21] Appl. No.: 334,703

[22] Filed: Apr. 6, 1989

[51] Int. Cl.[5] ..... A45D 44/10

[52] U.S. Cl. ..... 4/523; 4/519

[58] Field of Search ..... 4/515, 519, 523, 575

[56] References Cited

U.S. PATENT DOCUMENTS

| | | | |
|---|---|---|---|
| 1,898,272 | 2/1933 | Stern | 4/575 |
| 2,161,590 | 6/1939 | Rickard | 4/523 |
| 2,948,903 | 8/1960 | Gilmer | 4/523 |
| 3,078,474 | 2/1963 | Chaitlen | 4/575 |
| 4,327,452 | 5/1982 | Swatzell | 4/519 X |
| 4,649,580 | 3/1987 | Bastien | 4/519 X |

*Primary Examiner*—Charles E. Phillips

*Attorney, Agent, or Firm*—Blakely, Sokoloff, Taylor & Zafman

[57] ABSTRACT

A neck rest for a shampoo basin comprises a generally semi-cylindrical cushion made of a soft resilient material. The cushion preferably includes a thin coating of a waterproof and chemically resistant material. Attached to the inner semi-cylindrical surface of the cushion and extending tangentially outward therefrom is a flexible material having a plurality of small suction cups disposed thereon. The cushion, being made of a resilient material, conforms to the shape of the rim of a shampoo basin and is secured thereto by the suction cups on the inner semi-cylindrical surface. The outwardly extending flexible material defines a flap portion which is disposed against the inner wall of the basin and secured thereto by the suction cups. The neck support is thus firmly held in position so as to resist dislodgement during normal use, but may be easily removed by peeling up the flexible material so as to release the suction cups from the basin.

2 Claims, 1 Drawing Sheet

SHAMPOO BASIN NECK REST

BACKGROUND OF THE INVENTION

1. Field of the Invention

The present invention relates to equipment for use in connection with professional hairdressing and, more particularly, to a device attached to a sink, basin or the like for cushioning the neck of a hairdressing patron while being shampooed or having the hair treated.

2. Background Art

Professional barbers, hairdressers and the like generally employ a sink-like basin for shampooing the hair of their patrons. The patron generally reclines so that his or her head is within the basin, thereby requiring the patron's neck to lie across the rim of the basin. Such basins are typically made of porcelain, plastic, fiberglass, steel or another similar material, all of which can cause considerable discomfort to the patron's neck during the shampooing or hair treatment operations. Not only does the hardness of the sink's surface contribute to such discomfort, but the perceived surface temperature may also cause an unpleasant sensation when the patron reclines into the basin. Furthermore, if a patron lies directly on the rim of the sink, water is likely to run down the patron's neck and back, thereby causing further discomfort.

Several neck cushioning devices for use with shampooing basins and the like are known in the art. For example, U.S. Pat. No. 4,327,452 issued to Swatzell discloses a neck cushioning pad which fits over the rim of a sink. The neck cushioning pad of Swatzell is generally U-shaped with the leg portions inclined toward one another so as to grip the sink when mounted thereon.

A similar device is disclosed in U.S. Pat. No. 4,649,580 issued to Bastien. The device described by Bastien is also designed to fit over and grip the rim of a sink and includes a membrane for providing a water tight seal against the patron's neck.

Neck rest devices that are known in the prior art, such as the two described above, are designed with cross-sectional shapes to fit around and loosely grip the rim of the sink. Such devices lack a means for firmly securing the neck rest to the sink and are likely to become dislodged by movement of the patron's head before, during or after the shampooing or other hair treatment operation.

Accordingly, it is an object of the present invention to provide a neck rest for use with a shampoo basin that may be securely attached to the basin so as not to become dislodged during normal use. However, the neck rest of the present invention may be easily removed from the basin when it is desired to do so.

SUMMARY OF THE INVENTION

A neck rest according to the present invention comprises a generally semi-cylindrical cushion made of a soft, resilient material. The cushion preferably includes a thin coating of a waterproof and chemically resistant material. Attached to the inner semi-cylindrical surface of the cushion and extending tangentially outward therefrom is a flexible material having a plurality of small suction cups disposed thereon The cushion, being made of a resilient material, conforms to the shape of the rim of a shampoo basin and is secured thereto by the suction cups on the inner semi-cylindrical surface. The outwardly extending flexible material defines a flap portion which is disposed against the inner wall of the basin and secured thereto by the suction cups. The neck support is thus firmly held in position so as to resist dislodgement during normal use, but may be easily removed by peeling up the flexible material so as to release the suction cups from the basin.

The flap portion of the neck rest is preferably slit into two or more panels so that the cushion can more readily conform to the shape of the basin rim. This is particularly advantageous for use with basins that have a recess in the rim to receive a person's neck.

DETAILED DESCRIPTION OF THE INVENTION

Figure 1:
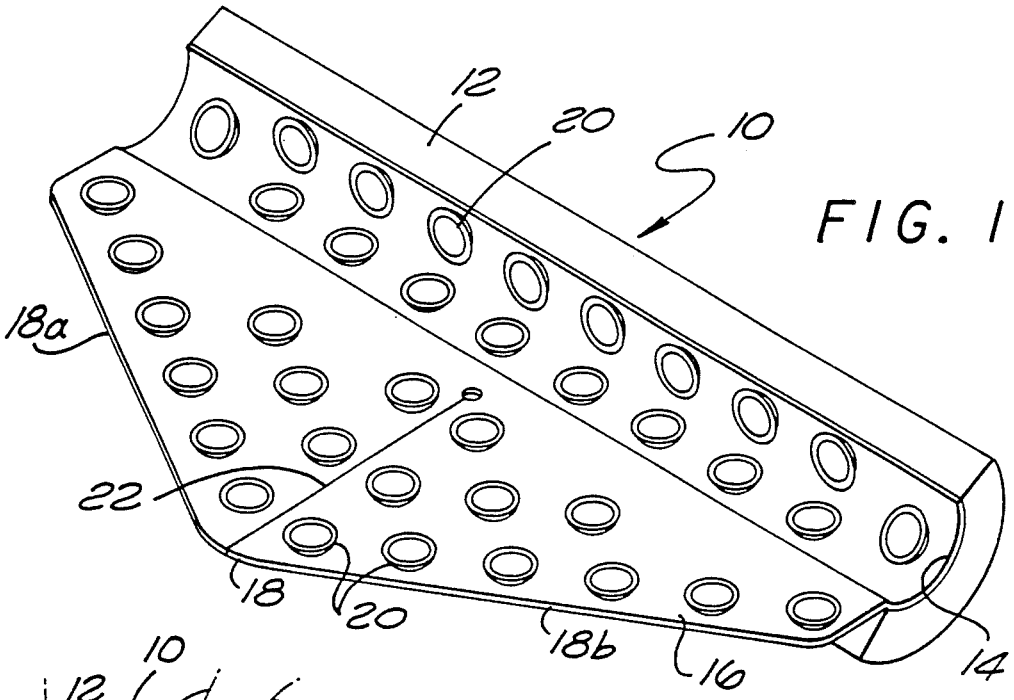
FIG. 1 is a perspective view of a neck rest according to the present invention.

A shampoo basin neck rest is disclosed. In the following description, for purposes of explanation and not limitation, specific numbers, dimensions, materials, etc. are set forth in order to provide a thorough understanding of the present invention. However, it will be apparent to one skilled in the art that the present invention may be practiced in other embodiments that depart from these specific details A perspective view of a neck rest according to the present invention is illustrated in FIG. 1. The neck rest, shown generally as 10, includes an elongated cushion portion 12 made of a suitably resilient material. Cushion portion 12 is preferably approximately 6 to 12 inches in length so as to be conveniently secured to shampoo basins of various designs and provide support for the back and sides of a patron's neck.

In a preferred embodiment, cushion portion 12 is conveniently formed in a semi-cylindrical shape from a cylinder of neoprene rubber or plastic foam that is slit lengthwise. Neoprene is preferred for its durability and resiliency, however, other rubber or foam materials may also be employed. The cylinder wall thickness is preferably approximately $\frac{3}{8}$ to $\frac{1}{2}$ inch with an internal diameter of approximately $1\frac{3}{8}$ inches.

Cushion portion 12 is preferably coated with a thin layer of PVC vinyl or similar material. Such coating is desirable to make cushion portion 12 waterproof and resistant to chemicals typically used by hairdressers. A vinyl coating on cushion 12 also aids in reducing wear and abrasion that would otherwise naturally result from repeated use. A smooth surface on cushion portion 12 is also important for maintaining neck rest 10 in a sanitary condition.

Neck rest 10 is secured to a shampoo basin by means of gripping material 16 that is secured to the inner surface 14 of cushion portion 12 and extends tangentially therefrom to form flap portion 18. Gripping material 16 has a plurality of suction cups 20 disposed thereon. Material 16 is preferably formed of a synthetic rubber-like material such that suction cups 20 may be formed integrally therewith by an injection molding or similar process. However, suction cups 20 may be otherwise secured to material 16 by mechanical fasteners, adhesives or other suitable means. Material 16 is secured to inner surface 14 of cushion portion 12 with a suitable adhesive (i.e. cyanoacrylate adhesive).

Other means of securing neck rest 10 to basin 24 may be employed and are within the scope of this invention. For example, if basin 24 is made of stainless steel or another ferrous material, magnets may be attached to or imbedded within material 16 as a means for securing the neck rest to the basin. Another possible technique for securing the neck rest to the basin is by use of a hook and loop material (e.g. VELCR material) on the neck rest and on the basin.

In the preferred embodiment of neck rest 10, flap portion 18 is divided into two symmetrical panels 18*a* and 18*b* by slit 22. This permits neck rest 10 to more readily and smoothly conform to the shape of a shampoo basin without stress as will be described below.

Figure 2A:
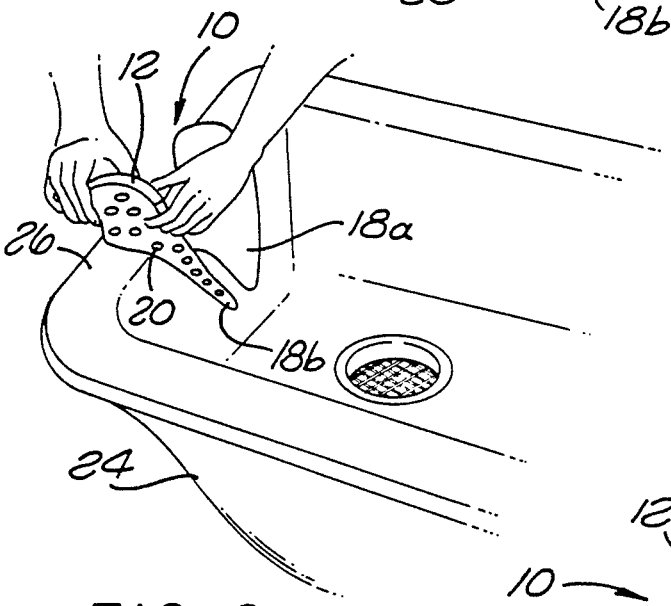
FIG. 2*a* is a perspective view illustrating placement of the neck rest of FIG. 1 on a typical shampoo basin.
Figure 2B:
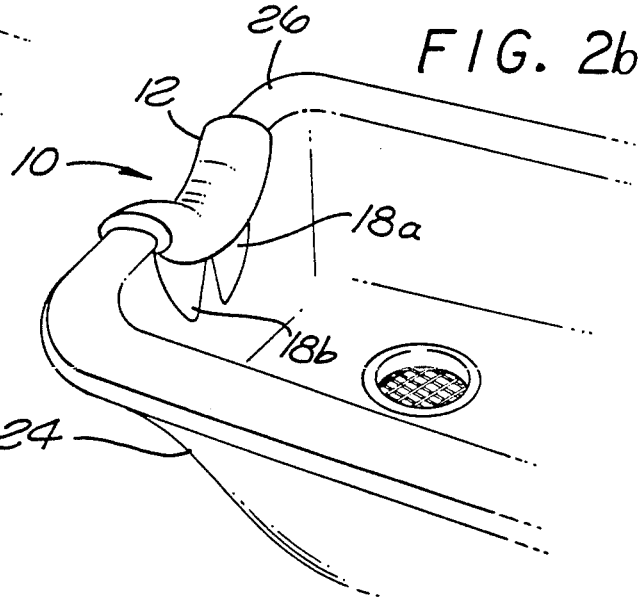
FIG. 2*b* illustrates the neck rest of FIG. 1 after installation on the rim of the shampoo basin.

Referring now to FIGS. 2*a* and 2*b*, installation of neck rest 10 on a shampoo basin will be described. Shampoo basins, such as basin 24, often incorporate a recess or indentation in the basin rim 26 to accommodate the neck of a patron. However, the present invention is not limited to use with basins of this type, and may be used with virtually any type or style of shampoo basin. Moreover, the present invention is not limited solely to use with shampoo basins. For example, neck rest 10 may also be used for neck support while reclining on a beach chair or similar article of furniture, or in bath tubs, whirlpools or spas.

As shown in FIG. 2*a*, inner surface 14 of cushion 12 is first secured to rim 26 in a position where the patron's neck will comfortably rest thereon. Flap panels 18*a* and 18*b* are then secured to inner wall 28 of basin 24. Slight hand pressure is generally sufficient to secure suction cups 20 to the surface of basin 24. However, as is widely known, adhesion can be improved by slightly moistening suction cups 20. Since flap 18 is slit into panels 18*a* and 18*b*, cushion 12 can be bent to conform to the curvature of basin rim 26 such as where a neck recess is provided. Without slit 22, flap 18 would tend to buckle as cushion 12 is bent, thereby impairing the adhesion of flap 18 to inner wall 28 of the basin.

When installation is completed as shown in FIG. 2*b*, neck rest 10 conforms to the shape of rim 26 and is firmly held in place by suction cups 20 disposed on both the inner surface 14 of cushion 12 and on flap panels 18*a* and 18*b*. In certain prior art neck rests, the neck rest would tend to rotate off of the rim of the basin as a patron moved about in the normal course of receiving a shampoo. Flap panels 18*a* and 18*b*, which extend down against inner wall 28, provide a large gripping surface so that neck rest 10 remains in place on rim 26, thereby resisting displacement. In some applications it may be desirous to install the neck rest 10 so that the flap panels 18*a* and 18*b* are secured on the external surface of the basin.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

We claim:

1. A neck rest for use with a shampoo basin comprising:

a cushion portion having a generally semi-cylindrical shape of generally uniform thickness and having inner and outer generally semi-cylindrical surfaces, said cushion portion having a core of resilient material coated with a layer of waterproof material;

a flap portion bonded to said inner generally semicylindrical surface of said cushion portion and extending generally tangentially therefrom, said flap portion having a surface including a plurality of suction cups formed integrally thereon for releasably securing said neck rest to the shampoo basin, wherein said flap portion is divided into at least two panels by a slit extending lengthwise through said flap portion from a position proximate to said cushion portion.

2. The neck rest of claim 1 wherein said cushion portion is made of neoprene, rubber or plastic foam coated with a vinyl material.

* * * * *

UNITED STATES PATENT AND TRADEMARK OFFICE

CERTIFICATE OF CORRECTION

PATENT NO. : 4,949,407

DATED : 8/21/90

INVENTOR(S) : Singer et al.

It is certified that error appears in the above-identified patent and that said Letters Patent is hereby corrected as shown below:

| | | |
|---|---|---|
| col. 01, line 63 | after "thereon" | insert --.-- |
| col. 02, line 29 | after "details" | insert --.-- |
| col. 03, line 08 | delete "VELCR" | insert --VELCRO-- |

Signed and Sealed this

Twentieth Day of April, 1993

*Attest:*

MICHAEL K. KIRK

*Attesting Officer*

*Acting Commissioner of Patents and Trademarks*